US006623133B1

(12) United States Patent
Keogh

(10) Patent No.: US 6,623,133 B1
(45) Date of Patent: Sep. 23, 2003

(54) ULTRAVIOLET LAMP RETAINER

(75) Inventor: Patrick Keogh, Crowthorne (GB)

(73) Assignee: Nordson Corporation, Westlake, OH (US)

( * ) Notice: Subject to any disclaimer, the term of this patent is extended or adjusted under 35 U.S.C. 154(b) by 526 days.

(21) Appl. No.: 09/702,492

(22) Filed: Oct. 31, 2000

(51) Int. Cl.[7] ..... A61G 13/00; F21V 13/00

(52) U.S. Cl. ..... 362/33; 362/147; 362/365; 362/226; 313/318.02

(58) Field of Search ..... 362/33, 147, 249, 362/274, 365, 389, 226, 260; 313/318.01, 318.02

(56) References Cited

U.S. PATENT DOCUMENTS 4,454,569 A * 6/1984 Maguire ..... 362/127

* cited by examiner

*Primary Examiner*—Stephen Husar
*Assistant Examiner*—Sharon Payne
(74) *Attorney, Agent, or Firm*—Wood, Herron & Evans, L.L.P.

(57) ABSTRACT

A lamp retaining device for holding a lamp within a housing. The lamp retaining device includes a bracket adapted to mount to a housing. The bracket includes a channel formed therein which has a portion oriented such that an end of the lamp will rest unaided thereon. To positively secure the lamp into the bracket, a retainer is coupled to the bracket. More specifically, the retainer includes a retaining portion which is configured for insertion into the channel to positively secure the end of the lamp into the oriented portion of the channel. The retainer further includes a coupler to allow selective coupling and uncoupling of the retainer and the bracket.

7 Claims, 4 Drawing Sheets

ULTRAVIOLET LAMP RETAINER

FIELD OF THE INVENTION

The present invention relates generally to ultraviolet lamp systems and, more particularly, to retainers for holding a ultraviolet lamp in a housing.

BACKGROUND OF THE INVENTION

Ultraviolet lamp systems are used for curing or drying adhesives, sealants, inks, coatings, and other similar materials. A typical ultraviolet lamp system includes a housing to which an ultraviolet lamp is detachably mounted by a pair of oppositely disposed holders. The holders receive and secure the ends of the ultraviolet lamp to the housing. In some ultraviolet lamp systems, each holder is connected to a source of electricity for energizing the ultraviolet lamp or bulb.

As can be appreciated, each ultraviolet lamp has a finite life after which the lamp burns out and must be replaced. Depending on the curing or drying application, several ultraviolet lamp systems may be used at one time. If, during the drying or curing process, one ultraviolet lamp burns out, the process may have to be interrupted until the ultraviolet lamp can be replaced with a new one. Such interruptions reduce production efficiency as the entire process must be stopped to install the new ultraviolet lamp.

When using prior ultraviolet lamp systems, the installation of a new ultraviolet lamp is relatively cumbersome and involves an unacceptably long interruption in the curing or drying process. In some instances the interruption can be as long as 30 minutes. A large portion of the time required to replace the ultraviolet lamp is consumed removing the fasteners which affix the ultraviolet lamp to the housing. Generally, several fasteners of various types must be removed using one or more hand tools, such as screwdrivers and wrenches. In addition, hand tools are needed to disconnect any electrical connections between the ultraviolet lamp and the housing. In many situations, an electrician must be employed when hand tools are required to disconnect the electrical connections. Having to call in an electrician further lengthens the down time of the production process and increases the cost of changing the ultraviolet lamp.

What is needed, therefore, is an ultraviolet lamp system which provides for quick and easy installation of an ultraviolet lamp. The ultraviolet lamp system should allow for installation of the ultraviolet lamp without using hand tools or requiring an electrician.

SUMMARY OF THE INVENTION

The present invention overcomes the foregoing and other shortcomings and drawbacks of prior lamp retaining devices used to hold ultraviolet lamps. The lamp retaining device of the present invention provides for quick and easy installation and/or removal of an ultraviolet lamp from a housing without requiring hand tools or the assistance of an electrician. Although the lamp retaining device of the present invention is especially suited for use with ultraviolet lamps, it is equally applicable for use with other types of lamps.

In accordance with the principles of the present invention, the lamp retaining device includes a bracket adapted to mount to a housing. The bracket includes a first channel formed therein having a portion oriented such that an end of the lamp will rest unaided thereon. In other words, once the lamp ends are placed into that portion of the channel, the lamp will remain therein without using any fasteners or retainers. However, to positively secure the lamp into the bracket, a retainer is coupled to the bracket. More specifically, the retainer includes a retaining portion which is adapted for insertion into the channel to positively secure the end of the lamp into the oriented portion of the channel. The retainer further includes a coupler to releaseably couple the retainer to the bracket. Preferably, the channel is L-shaped and one leg of the L-shaped channel corresponds to the oriented portion discussed above. Advantageously, the retaining portion includes a spring loaded projection which is adapted to contact the lamp end with a positively acting force. Preferably, the spring loaded projection is a spring loaded ball bearing.

In a further aspect of the invention, the housing includes an end member which is disposed adjacent to but not in contact with the bracket. The end member has a second channel formed therein which is similar to the first channel in the bracket. As such, the retainer not only includes a retaining portion for insertion into the first channel of the bracket, but also a filler member for insertion into the second channel in the end member. The filler member in cooperation with the end member helps block heat from the lamp from getting to portions of the housing which are not actively cooled.

In another aspect of the invention, the bracket includes a fastener and the coupler on the retainer includes a sliding member. The sliding member moves between latched and unlatched positions relative to the fastener to respectively couple and uncouple the retainer and the bracket.

Various additional advantages and features of the invention will become more readily apparent to those of ordinary skill in the art upon review of the following detailed description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE PREFERRED EMBODIMENT

Figure 1:
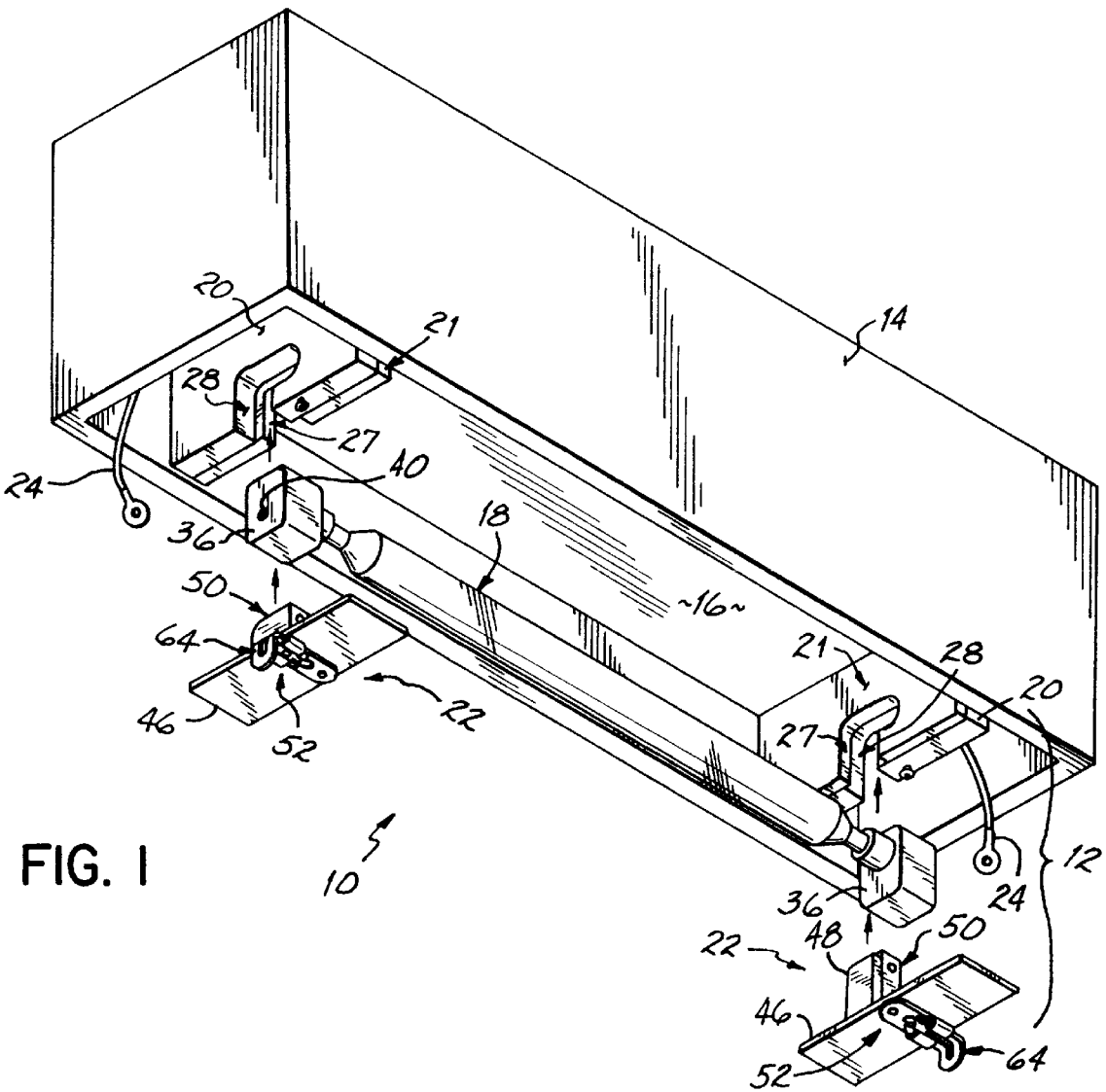
FIG. 1 is a disassembled bottom perspective view of the ultraviolet lamp retaining device of the present invention.

With reference to the FIG. 1, an ultraviolet lamp system 10 incorporates a lamp retaining device 12 constructed in accordance with the principles of the present invention. It will be appreciated that the lamp retaining device 12 of the present invention is not limited to the installation and retention of only ultraviolet lamps. The invention is equally applicable to other types of elongated, tubular lamps or even single-end light bulbs.

The ultraviolet lamp system 10 includes a lamp housing 14 which is operatively connected to a source of chilled water and a source of electricity (not shown). The lamp housing 14 includes a water cooled manifold 16 which is operatively connected to the source of chilled water. The water cooled manifold 16 serves to cool the ultraviolet lamp system 10 while it is operational, such as during a heating or curing application. The ultraviolet lamp system further includes an ultraviolet lamp 18 which is selectively removable from the lamp retaining device 12. Preferably, the ultraviolet lamp 18 is made from quartz.

The lamp retaining device 12 includes a lamp bracket 20 which is mounted to and in thermal contact with the water cooled manifold 1 6 by fasteners (not shown). As such, lamp bracket 20 is cooled by water cooled manifold 16 while the ultraviolet lamp system 10 is operative. To provide further thermal protection to the lamp bracket, a housing end member 21 is disposed adjacent lamp bracket 20. The housing end member 21 is also in thermal contact with the water cooled manifold 16 and shields the lamp bracket 20 from the direct ultraviolet light rays emitted from the ultraviolet lamp 12. Lamp retaining device 12 also includes a lamp retainer 22 which is selectively coupled to lamp bracket 20 to securely hold ultraviolet lamp 18 thereto. Lamp housing 14 further includes electrical connector 24 which is operatively connected to a source of electricity.

Figure 2:
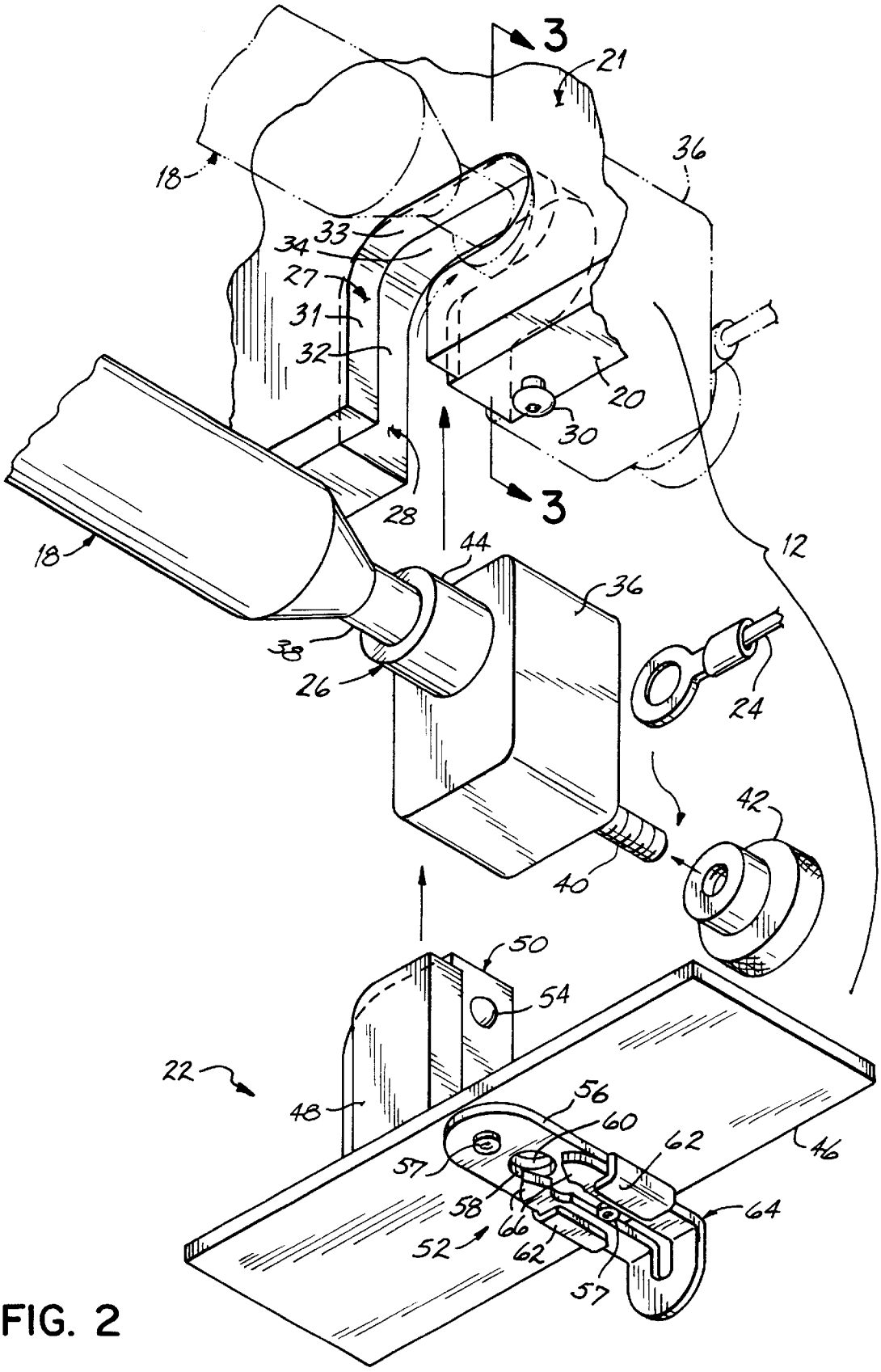
FIG. 2 is an enlarged disassembled perspective view of the lamp retaining device of FIG. 1.

With reference to FIG. 2, a lamp end 26 of ultraviolet lamp 18 is shown being installed into the lamp retaining device 12. The installation of lamp end 26 is substantially the same as that for the opposite end of the ultraviolet lamp 18 so the following discussion will be similarly applicable to that opposite lamp end. Housing end member 21 and lamp bracket 20 include channels 27, 28, respectively, both of which are generally L-shaped. Lamp bracket 20 further includes a fastener 30. The L-shaped channels 27, 28 include vertical portions 31, 32 and horizontal portions 33, 34.

Lamp end 26 includes an end fixture 36 which is fixedly secured by cement to a terminal end 38 of ultraviolet lamp 18. An ultraviolet lamp 18 with end fixtures 36 of the type shown in FIGS. 1 and 2 is manufactured by Primearc, a subsidiary of the assignee of the present invention. Preferably, end fixture 36 is made of a ceramic material. When the ultraviolet lamp 18 burns out, the ultraviolet lamp 18 including end fixtures 36 is removed and replaced with a new ultraviolet lamp 18 with new end fixtures 36.

The end fixture 36 includes a threaded electrical member 40 for threadingly receiving a thumb nut 42. During installation of the ultraviolet lamp 18, electrical connector 24 is placed over threaded electrical member 40 and thumb nut 42 is threaded thereon. The thumb nut 42 is readily removed by hand from the threaded electrical member 40 without the use of hand tools. It will be appreciated that the end fixture 36 could have a female positive electrical connector into which a male positive thumb screw is inserted to secure electrical connector 24. Alternatively, electrical connector 24 could have an electrical plug that engages a complementary electrical receptacle in end fixture 36 such that no other fasteners are required. Whichever connecting scheme is used, electrical connector 24 should be securely fastened to end fixture 36 to avoid electrical arcing during when the ultraviolet lamp system 10 is operative.

End fixture 36 further includes a bushing 44 which is sized to conform to the L-shaped channel 28. The L-shaped channel 27 of housing end member 21 is sized to conform to the terminal end 38 of ultraviolet lamp 18 which has a smaller diameter than that of bushing 44. When end fixture 36 is inserted into L-shaped channel 28, bushing 44 rests upon the horizontal portion 34 (FIG. 3) and remains therein without any further fasteners, allowing the ultraviolet lamp 18 to be installed by only one person because there is no need for a second person to hold the other end while lamp end 26 is being installed.

Figure 3:
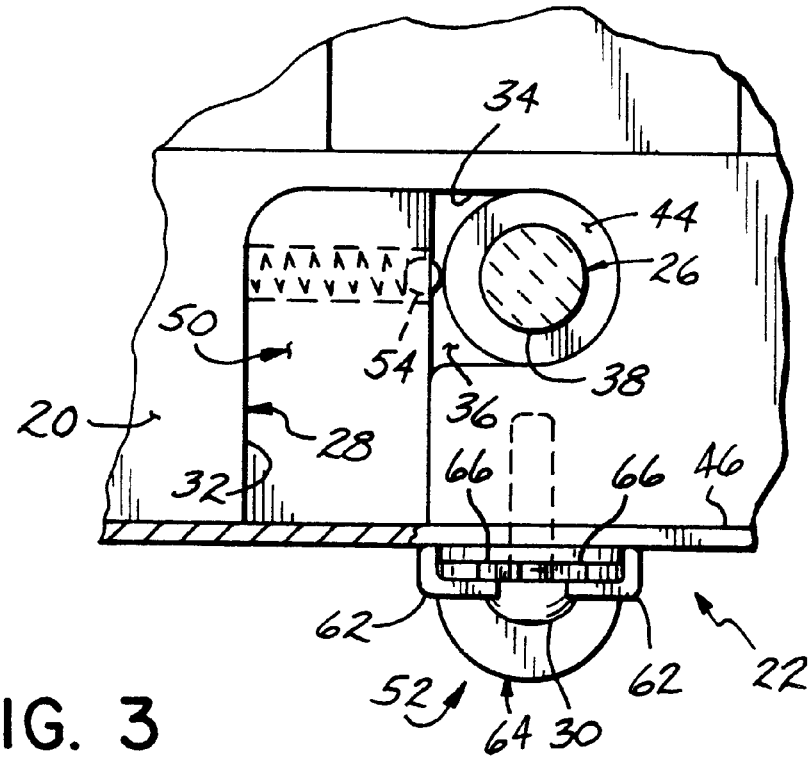
FIG. 3 is a cross-sectional view of the assembled lamp retaining device taken along line 3—3 in FIG. 2.

Lamp retainer 22 includes a mounting plate 46. Affixed to the mounting plate 46 are a filler member 48, a retaining portion 50 and a coupler 52. Advantageously, filler member 48 and retaining portion 50 are spaced apart from each other so that heat is not transferred from filler member 48 to retaining portion 50. Filler member 48 is sized to substantially fill the vertical portion 31 of the L-shaped channel 27 when inserted therein. The filler member 48 in cooperation with the housing end member 21 provides further thermal shielding from the heat generated by an operational ultraviolet lamp 18, minimizing heating of non-cooled sections of the lamp housing 14. Advantageously, housing end member 21 and filler member 48 are constructed of a material capable of withstanding high temperatures. Retaining portion 50, which is sized to substantially fill the vertical portion 32 of L-shaped channel 28, includes a spring loaded ball bearing 54 which positively contacts bushing 44 when lamp retainer 22 is affixed to lamp bracket 20. The ball bearing 54 provides a positive contact force against bushing 44 to minimize unwanted movements and vibrations of ultraviolet lamp 18 that may be experienced during a particular heating or curing application. More importantly and as shown in FIG. 3, ball bearing 54 pushes bushing 44 into contact with the end of the horizontal portion of L-shaped channel 28 so that bushing 44 and end fixture 36 is cooled by water cooled lamp bracket 20. Vertical portions 31, 32 are transversely offset from one another such that when filler member 48 and retaining portion 50 are positioned in vertical portions 31, 32, respectively, there is no line-of-sight gaps for ultraviolet lights rays to directly pass therethrough. This offset helps to minimize heating of non-cooled sections of the lamp housing 14.

Coupler 52 includes fixed member 56 affixed to mounting plate 46 by fasteners 57. Fixed member 56 includes a throughhole 58 aligned with a throughhole 60 in mounting plate 46. Fixed member 56 includes folded tabs 62 which form a channel through which a sliding member 64 can slidably move therethrough. Sliding member 64 includes opposing flexible members 66 which clampingly engage fastener 30 when sliding member 64 is moved from an unlatched position to a latched position.

Figure 4A:
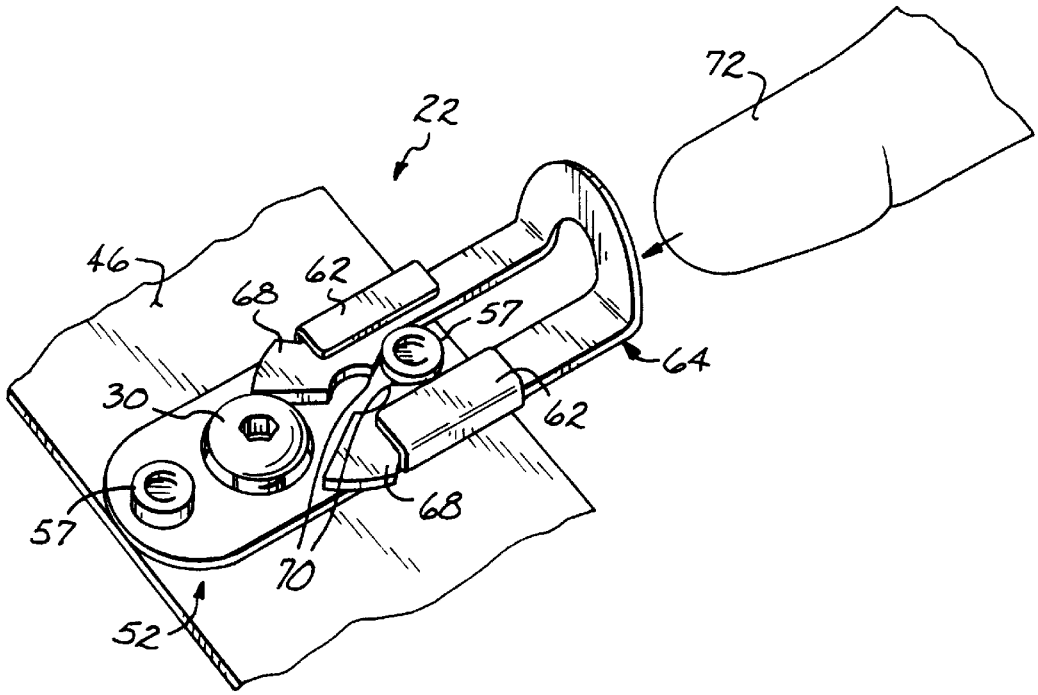
FIG. 4A is an enlarged partial perspective view of the lamp retainer of FIG. 2 shown in the unlatched position.
Figure 4B:
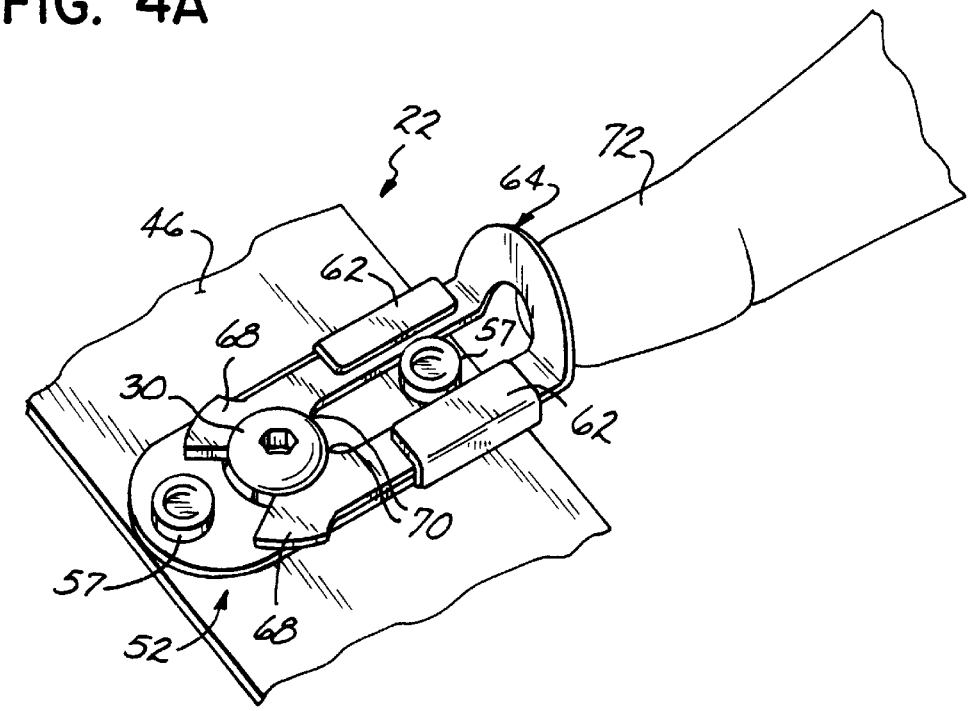
FIG. 4B is an enlarged partial perspective view of the lamp retainer of FIG. 2 shown in the latched position.

A preferred embodiment of the coupler 52 is shown in FIGS. 4A and 4B. Sliding member 64 includes outer extensions 68 along the outside edges of flexible members 66 to prevent the sliding member 64 from sliding out of the channel formed by tabs 62 when sliding member 64 is moved to the unlatched position (FIG. 4A). Sliding member 64 also includes inner extensions 70 along the interior edges of flexible members 66 to ensure that the sliding member 66 does not move beyond the fastener 30 when the sliding member 66 is moved to the latched position (FIG. 4B).

To install ultraviolet lamp 18 into the lamp housing 1 4, the terminal ends 38 and bushing 44 of a new ultraviolet lamp 18 are slid upwardly into vertical portions 31, 32 and then over into horizontal portions 33, 34. At this point, the ultraviolet lamp 18, and more specifically bushing 44, rests unaided upon horizontal portion 34 without needing any fasteners to hold the ultraviolet lamp 18 in place. Electrical connector 24 is then affixed to threaded electrical member 40 by thumb nut 42. Lamp retainer 22 is then coupled to lamp bracket 20. More specifically, filler member 48 and retaining portion 50 are inserted respectively into vertical portions 31, 32 of L-shaped channels 27, 28 and fastener 30 is inserted through throughholes 60, 58. Once the lamp retainer 22 is in place, sliding member 64 is moved by a hand or finger 72 from an unlatched position (FIG. 4A) to a latched position (FIG. 4B) such that flexible members 66 engage and surround fastener 30 to positively secure lamp retainer 22 to lamp bracket 20. The entire installation procedure can be conducted without the use of any hand tools or the assistance of an electrician. The ultraviolet lamp 18 can be removed from the lamp housing 14 by simply reversing the installation process.

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

Having described the invention, I claim:

1. An lamp retaining device for holding an elongated lamp within a housing comprising:

a bracket adapted to mount to the housing and having a first channel formed therein, said channel having a first portion oriented to secure an end of the lamp; and a retainer having a second portion configured for insertion into said channel to positively secure the end of the lamp into said first portion of said channel, said retainer further having a coupler to allow selective coupling and uncoupling of said retainer and said bracket.

2. The lamp retaining device of claim 1, wherein the housing further includes an end member disposed adjacent to said bracket, each end member comprises a second channel, said retainer further comprises a filler member configured for insertion into said second channel in said end member.

3. The lamp retaining device of claim 1, wherein said end retainer comprises a spring loaded projection adapted to positively contact the lamp end and retain it against said bracket.

4. The lamp retaining device of claim 1, wherein said bracket comprises a fastener, said coupler comprises a sliding member selectively moveable between latched and unlatched positions, in said latched position said sliding member engages said fastener to couple and retain said retainer to said bracket and in said unlatched position said sliding member disengages from said fastener to allow said retainer to uncouple from said bracket.

5. An ultraviolet lighting device comprising:

a housing having first and second ends;

an elongated ultraviolet lamp having first and second end fixtures;

first and second brackets respectively mounted at said first and second ends of said housing, each bracket having a first channel formed therein, each channel having a first portion oriented such that said end fixtures will rest unaided thereon; and first and second retainers, each retainer having a second portion configured for insertion into said first channels in said first and second brackets to positively secure each end fixture into said first portion of said first channel, each retainer further including a coupler to allow selective coupling and uncoupling of said retainers relative to said brackets.

6. The ultraviolet lighting device of claim 5, wherein said housing further comprises first and second end members disposed respectively adjacent to said first and second brackets, each end member having a second channel formed therein, each of said first and second retainers further comprising a filler member configured for insertion into said second channels in said first and second end members.

7. The ultraviolet lighting device of claim 5, wherein said bracket comprises a fastener and said coupler comprises a sliding member which is selectively moveable between latched and unlatched positions, in said latched position said sliding member engages said fastener to couple and retain said retainer to said bracket and in said unlatched position said sliding member disengages from said fastener to allow said retainer to uncouple from said bracket.

* * * * *